US011628975B2

(12) United States Patent
Sprick et al.

(10) Patent No.: US 11,628,975 B2
(45) **Date of Patent: *Apr. 18, 2023**

(54) CLOSURE

(71) Applicant: BERRY PLASTICS CORPORATION, Evansville, IN (US)

(72) Inventors: William D. Sprick, Evansville, IN (US); Todd D. Faubion, Rockport, IN (US); Mark A. Deutsch, Haubstadt, IN (US); Jason A. Bragg, Chandler, IN (US); Karla S. Koring, Mount Vernon, IN (US)

(73) Assignee: Berry Plastics Corporation, Evansville, IN (US)

( * ) Notice: Subject to any disclaimer, the term of this patent is extended or adjusted under 35 U.S.C. 154(b) by 267 days.

This patent is subject to a terminal disclaimer.

(21) Appl. No.: 16/893,512

(22) Filed: Jun. 5, 2020

(65) Prior Publication Data

US 2020/0299031 A1 Sep. 24, 2020

Related U.S. Application Data

(63) Continuation of application No. 16/235,809, filed on Dec. 28, 2018, now Pat. No. 10,689,158, which is a (Continued)

(51) Int. Cl.
*B65D 25/48* (2006.01)
*B65D 1/02* (2006.01)
(Continued)

(52) U.S. Cl.
CPC ..... *B65D 25/48* (2013.01); *B65D 1/023* (2013.01); *B65D 41/04* (2013.01); *B65D 41/26* (2013.01);
(Continued)

(58) Field of Classification Search
CPC ..... B65D 25/48; B65D 1/023; B65D 41/04; B65D 41/26; B65D 47/06; B65D 47/40; B65D 2401/25; B65D 2401/00
See application file for complete search history.

(56) References Cited

U.S. PATENT DOCUMENTS 2,601,040 A 6/1952 Livingstone
3,917,097 A 11/1975 Uhlig
(Continued)

FOREIGN PATENT DOCUMENTS

CN 2214374 Y 12/1995
JP 3152639 U 8/2009
(Continued)

OTHER PUBLICATIONS

International (PCT) Search Report and Written Opinion for PCT/US17/31081 dated Jul. 31, 2017, 12 pages.
(Continued)

*Primary Examiner* — Vishal Pancholi
*Assistant Examiner* — Robert K Nichols, II
(74) *Attorney, Agent, or Firm* — Barnes & Thornburg LLP

(57) ABSTRACT

A package includes a container and a closure cap for mounting on the container. The closure cap is coupled to a neck of the container to block selectively removal of product stored within the container at the selection of a user.

20 Claims, 5 Drawing Sheets

Related U.S. Application Data continuation of application No. 15/586,969, filed on May 4, 2017, now Pat. No. 10,207,840.

(60) Provisional application No. 62/332,128, filed on May 5, 2016.

(51) Int. Cl.

| | |
|---|---|
| ***B65D 41/04*** | (2006.01) |
| ***B65D 41/26*** | (2006.01) |
| ***B65D 47/06*** | (2006.01) |
| ***B65D 47/40*** | (2006.01) |

(52) U.S. Cl.

CPC ..... *B65D 47/06* (2013.01); *B65D 47/40* (2013.01); *B65D 2401/00* (2020.05); *B65D 2401/25* (2020.05)

(56) References Cited

U.S. PATENT DOCUMENTS

| | | | | |
|---|---|---|---|---|
| 4,133,462 | A | 1/1979 | Lindstrom | |
| 4,830,234 | A | 5/1989 | Odet | |
| 4,974,749 | A | 12/1990 | Mon | |
| 4,993,605 | A | 2/1991 | Del Re | |
| 5,101,993 | A | 4/1992 | Nairn | |
| 5,234,130 | A * | 8/1993 | Benioff | B29C 66/1222 215/390 |
| 5,386,918 | A * | 2/1995 | Neveras | B65D 47/0838 215/254 |
| 5,462,202 | A | 10/1995 | Haffner | |
| 5,794,803 | A | 8/1998 | Sprick | |
| 5,806,698 | A * | 9/1998 | Aguirrezabal | B65D 47/0804 215/235 |
| 7,097,076 | B1 | 8/2006 | Giblin | |
| 7,621,413 | B2 * | 11/2009 | Miota | B65D 47/0804 220/300 |
| 8,011,535 | B2 | 9/2011 | Tauber | |
| 9,371,165 | B2 | 6/2016 | Brannon | |
| 9,446,885 | B2 | 9/2016 | Doubles | |
| 2007/0194047 | A1 | 8/2007 | Tauber | |
| 2009/0242564 | A1 * | 10/2009 | Danks | B65D 47/0838 220/361 |
| 2015/0048113 | A1 | 2/2015 | Brannon | |

FOREIGN PATENT DOCUMENTS

| | | |
|---|---|---|
| WO | 2007145558 | 12/2007 |
| WO | 2012052701 | 4/2012 |

OTHER PUBLICATIONS

Office Action dated Jun. 4, 2018 for U.S. Appl. No. 15/586,969 (pp. 1-6).

Chinese Office Action for Chinese Application No. 201780027844.7 dated Sep. 9, 2019, 13 pages.

Second Chinese Office Action for Chinese Application No. 201780027844.7 dated Jun. 29, 2020, 4 pages.

* cited by examiner

CLOSURE

PRIORITY CLAIM

This application is a continuation of U.S. application Ser. No. 16/235,809, filed Dec. 28, 2018, which is a continuation of U.S. application Ser. No. 15/586,969, filed May 4, 2017, which claims priority under 35 U.S.C. § 119(e) to U.S. Provisional Application No. 62/332,128, filed May 5, 2016, each of which is expressly incorporated by reference herein.

BACKGROUND

The present disclosure relates to a container closure, and particularly to a closure for mounting on the top of a bottle or other container. More particularly, the present disclosure relates to a closure and pour spout associated with a bottle or container finish or neck.

SUMMARY

According to the present disclosure, a package includes a container and a closure cap for mounting on the container. The closure cap is coupled to a neck of the container to block selectively removal of product stored in the container. A product measuring cup included in the closure cap covers a discharged tube coupled to the container when the closure cap is mounted on the container.

In illustrative embodiments, the closure cap includes the product measuring cup and a spout sealer for forming a seal with the neck of the container. A pour-spout insert is coupled to the container and includes the discharge tube and a product-drainback aperture. The closure cap is formed to define a residual-product catch basin to collect excess product remaining on an exterior surface of the product measuring cup after a user discharges product from the container into the product measuring cup. The closure cap seals against the container and directs the excess product held in the product measuring cup and residual-product catch basin toward the product-drainback aperture to re-enter the container and minimize waste of the product.

In illustrative embodiments, the package further includes a child-resistant lock. The child-resistant lock includes a lock tab coupled to the closure cap and a companion stationary tab blocker coupled to the container. The tab blocker engages with the lock tab to block rotation of the closure cap relative to the container to block removal of the closure cap. An adult user engages an annular outer sidewall of the closure cap to move the lock tab relative to the tab blocker to remove the lock tab from engagement with the tab blocker and allow removal of the closure cap from the container.

In illustrative embodiments, the closure cap rotates relative to the container about an axis during mounting and dismounting of the closure cap. The spout sealer includes a rim sealer and a plug wall. The rim sealer seals against a rim of the neck of the container and the plug wall seals against an interior of the neck when the closure cap is mounted on the container. In a first angular position of the closure cap, the plug wall and rim seal are both engaged with the neck to seal an opening of the container. In a second angular position of the closure cap, the plug wall is engaged with the neck to seal the opening and the rim sealer is spaced apart from the neck.

In illustrative embodiments, a tamper-evident band is coupled to the closure cap through a frangible connection. The tamper-evident band engages with the container to block or limit rotation of the closure cap while the tamper-evident band is coupled to the closure cap. A user removes the tamper-evident band along the frangible connection to allow the closure cap to dismount from the container.

Additional features of the present disclosure will become apparent to those skilled in the art upon consideration of illustrative embodiments exemplifying the best mode of carrying out the disclosure as presently perceived.

BRIEF DESCRIPTIONS OF THE DRAWINGS

The detailed description particularly refers to the accompanying figures in which.

Figure 1:
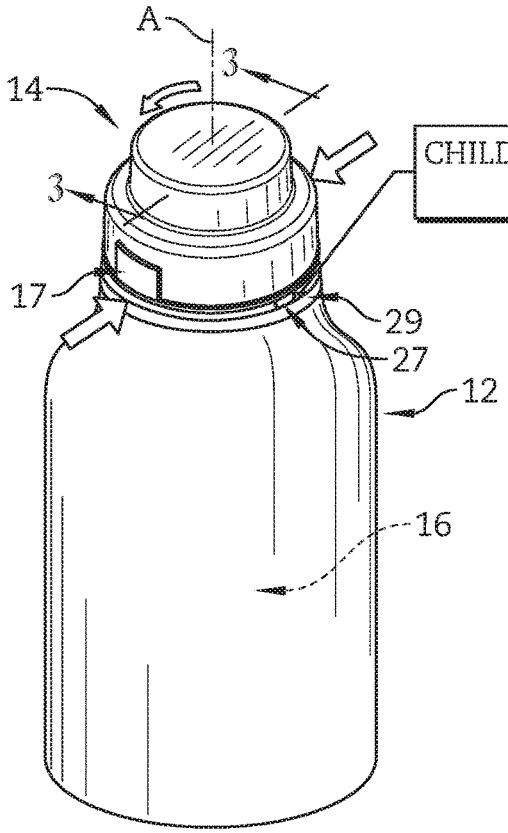
FIG. 1 is a perspective view of a package including one embodiment of a closure cap in accordance with the present disclosure showing the closure cap mounted on a container and suggesting that a child-resistant lock is formed between the container and closure cap to block selectively removal of the closure cap at the selection of an adult user.
Figure 3:
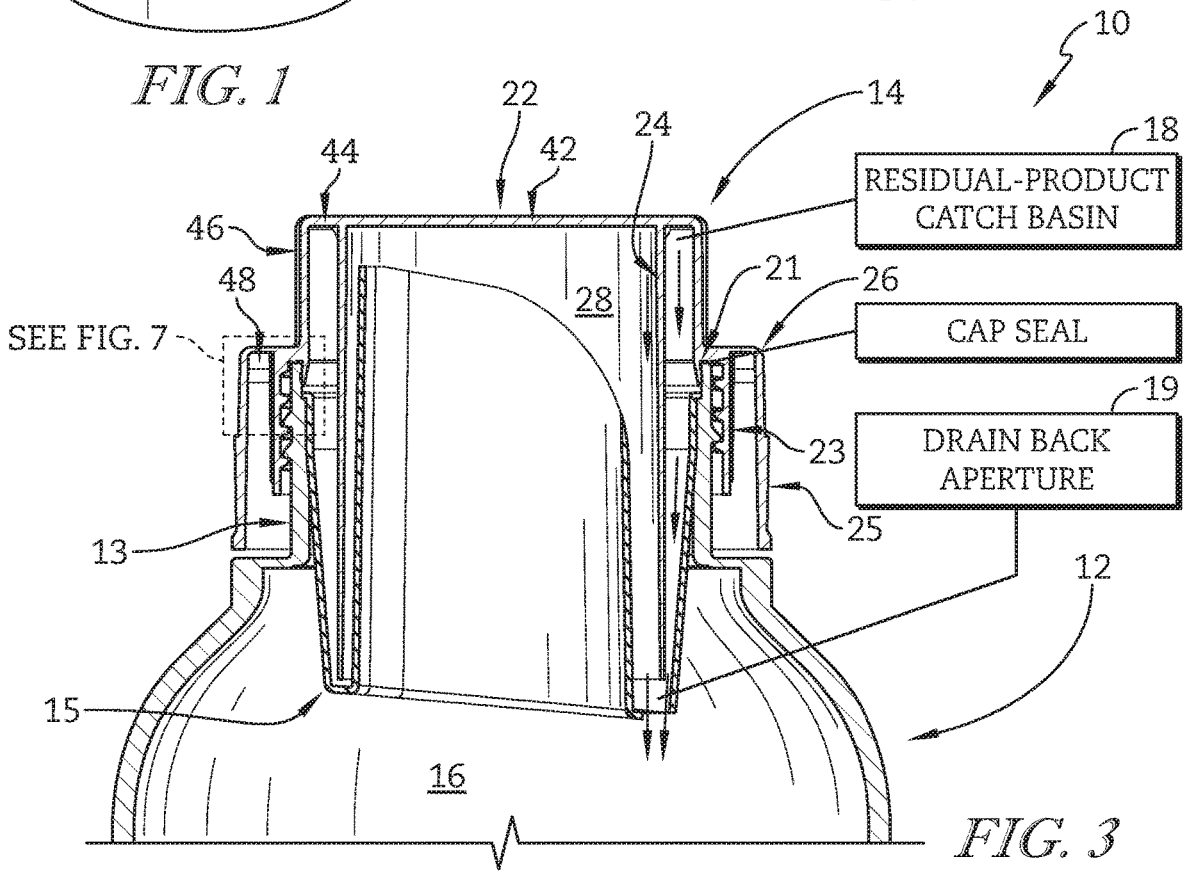
Figure 4:
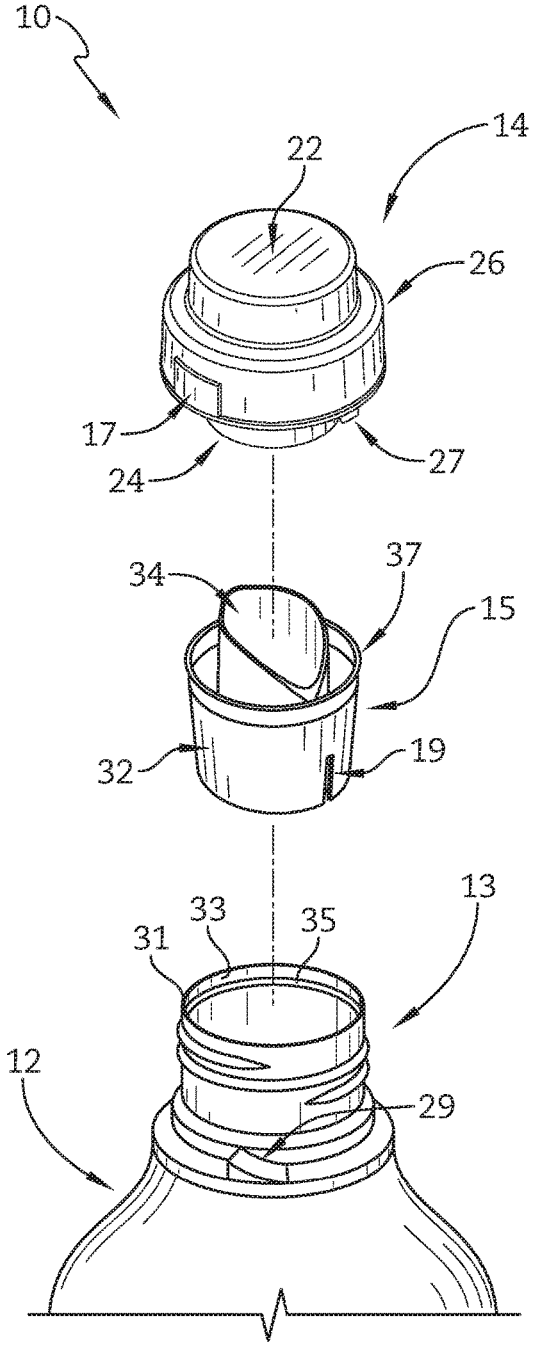
Figure 5:
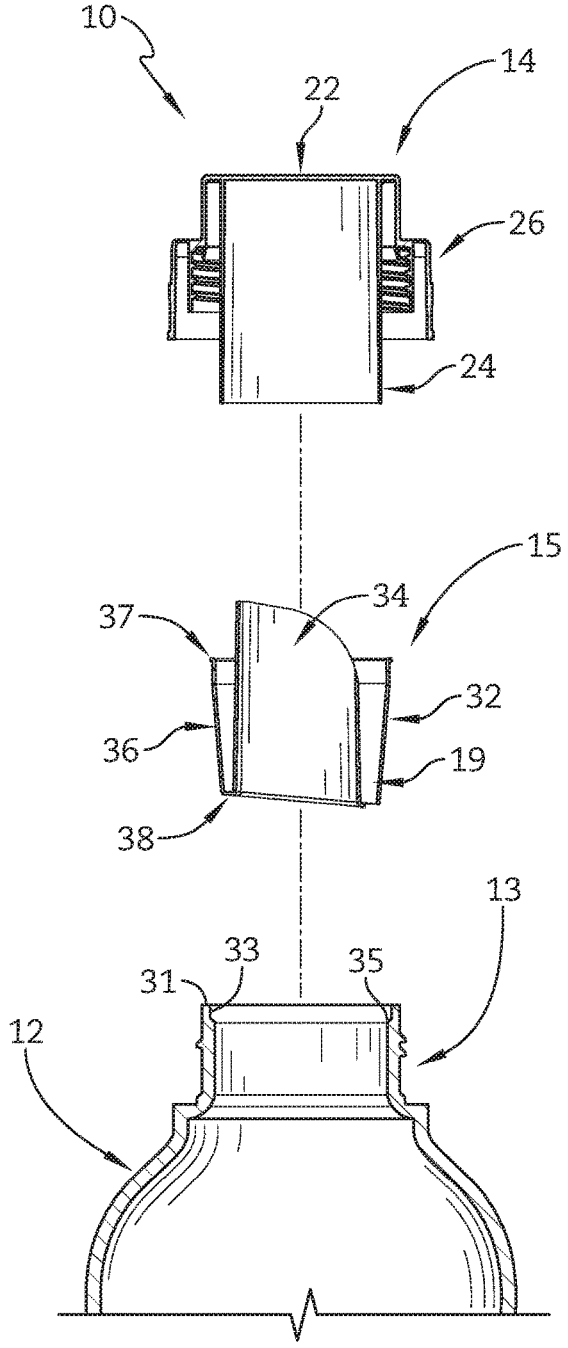
Figure 6:
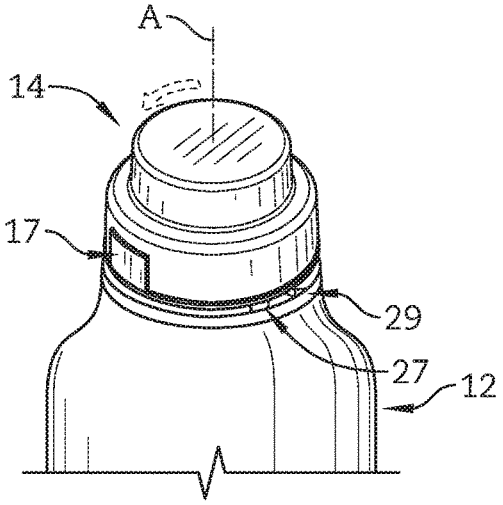
Figure 7:
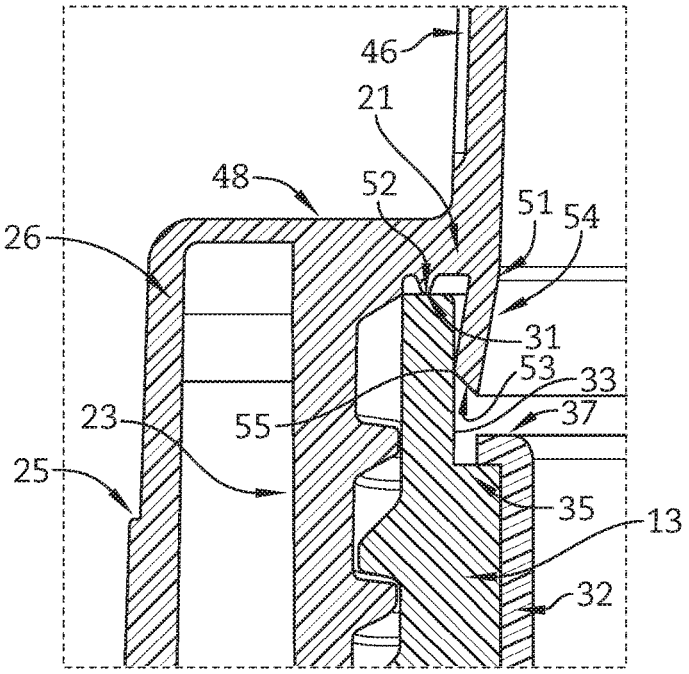
Figure 8:
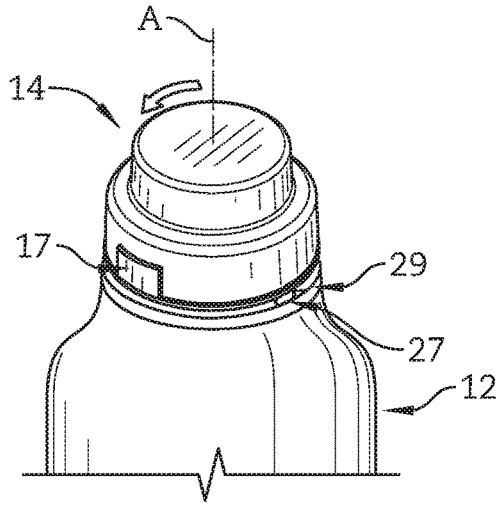
Figure 9:
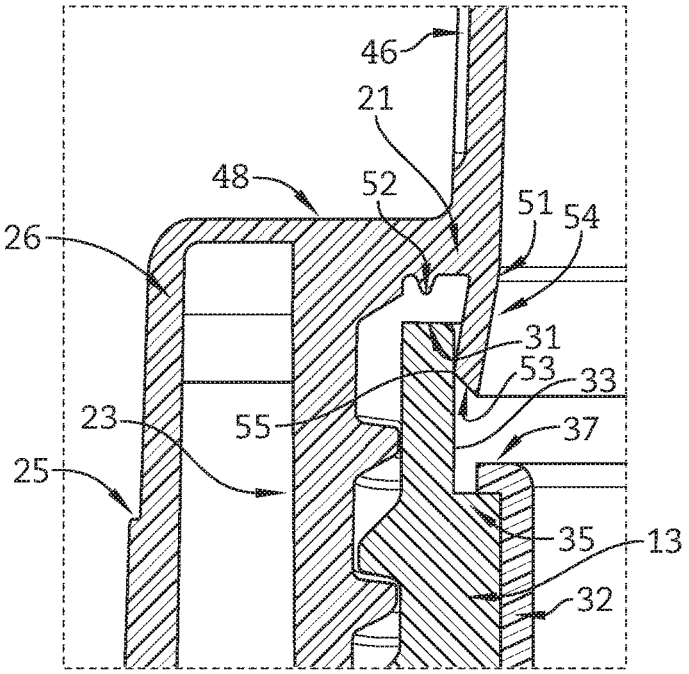
Figure 10:
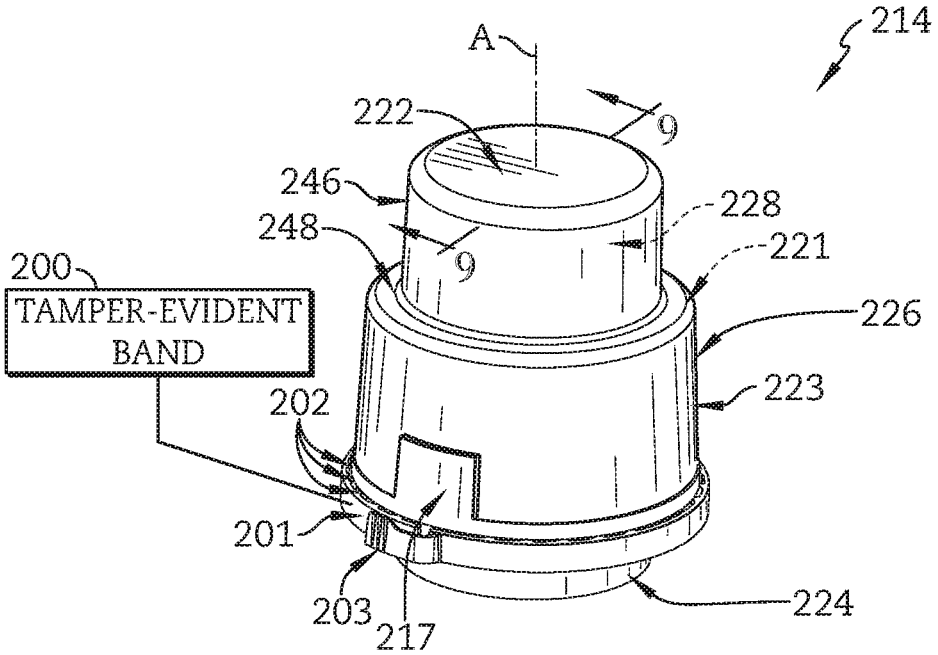
Figure 11:
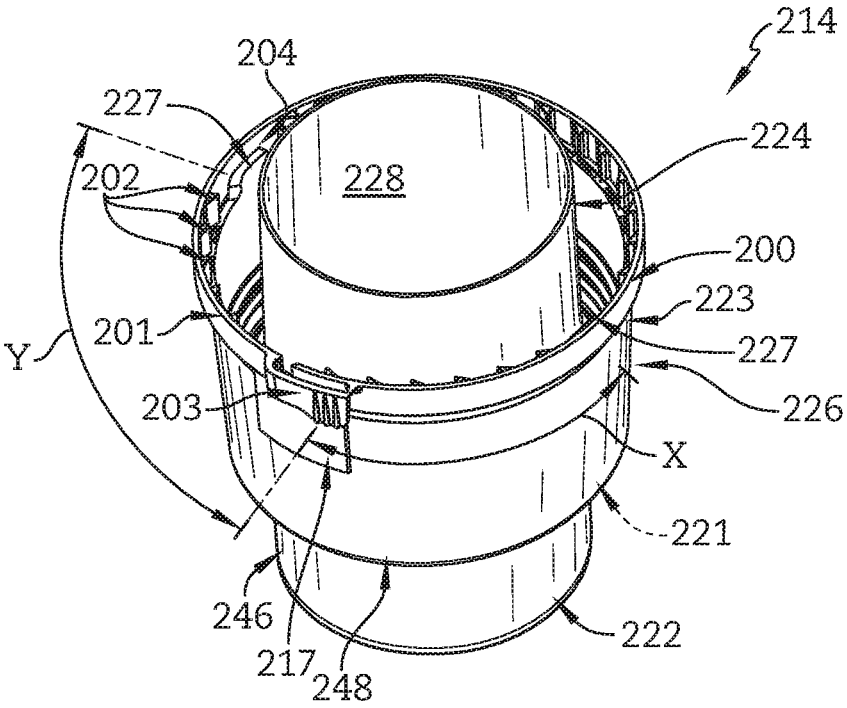
Figure 12:
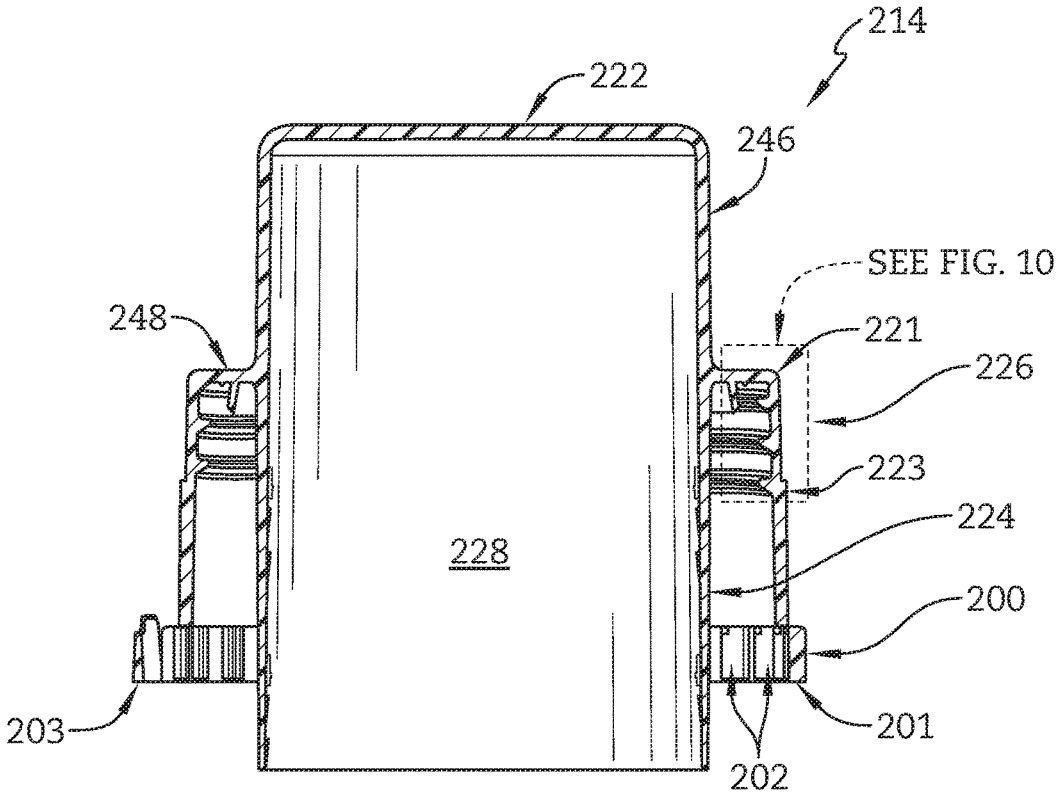
Figure 13:
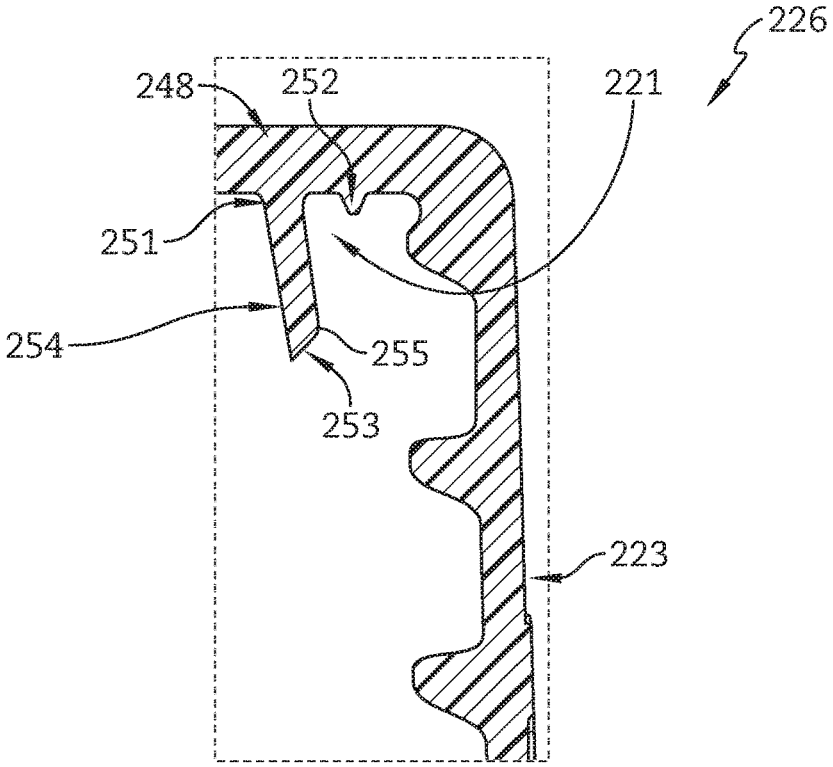

FIG. 3 is a partial sectional view taken along line 3-3 of FIG. 1 showing the closure cap mounted on a neck of the container and suggesting that a seal is established between the cap and the container to block removal of product stored in the container and showing that a residual-product catch basin of the closure cap collects excess product remaining on an exterior surface of the product measuring cup after a user discharges product from the container into the product measuring cup and directs the excess product toward a product-drainback aperture to re-enter the container;

FIG. 4 is an exploded assembly view of the package of FIG. 1 showing that a pour-spout insert includes the discharge tube, a product drainback cup coupled to the discharge tube, and the product-drainback aperture formed in a lower portion of the product drainback cup and suggesting that the pour-spout insert is received in the neck of the container to couple the pour-spout insert to the container;

FIG. 5 is a sectional exploded assembly view of the package of FIG. 4 showing that the product drainback cup of the pour-spout insert is sized to extend into the neck of the container and that the product measuring cup is sized to receive the discharge tube of the pour-spout insert when the pour-spout insert and closure cap are mounted on the container;

FIG. 6 is an enlarged view of the package of FIG. 1 showing the closure cap rotated relative to the container to a first angular position such that the lock tab is spaced apart from the tab blocker;

FIG. 7 is an enlarged view of the package of FIG. 3 showing that a spout sealer of the closure cap includes an annular plug wall and an annular rim sealer and suggesting that the plug wall engages with an interior surface of the neck of the container to form a plug seal with the container and that the rim seal engages with a rim of the neck to form a seal along the rim when the closure cap is mounted on the container in the first angular position;

FIG. 8 is a view similar to FIG. 6 showing the closure cap rotated relative to the container to a second angular position such that the lock tab is engaged with the tab blocker;

FIG. 9 is a view similar to FIG. 7 showing the plug wall engaged with the interior surface of the neck and the rim sealer spaced apart from the rim of the neck when the closure cap is mounted on the container in the second angular position shown in FIG. 8;

FIG. 10 is a perspective view of another embodiment of a closure cap in accordance with the present disclosure showing that the closure cap includes a product measuring cup, an outer shell extending around the product measuring cup, and a tamper-evident band coupled to a lower perimeter of the outer shell by a frangible connection;

FIG. 11 is a lower perspective view of the closure cap of FIG. 7 showing that the tamper-evident band includes a strip and a plurality of directionally molded retention tabs spaced around an inner perimeter of the strip and suggesting that the retention tabs engage with the container to block rotation of the closure cap at the selection of a user;

FIG. 12 is a sectional view taken along line 9-9 in FIG. 7 showing that a spout sealer is coupled to the outer shell; and FIG. 13 is an enlarged view of the closure cap of FIG. 9 showing that the spout sealer of the closure cap includes an annular plug wall and an annular rim sealer.

DETAILED DESCRIPTION

A package 10 in accordance with the present disclosure is shown in FIG. 1. Package 10 includes a container 12 and one embodiment of a closure cap 14 in accordance with the present disclosure configured to mount on container 12 along an axis A. A child-resistant lock 11 is formed between closure cap 14 and container 12 to block removal of closure cap 14 at the selection of an adult user. An adult user engages one or more pads 17 on closure cap 14 to disengage child-resistant lock 11 and allow removal of closure cap 14 from container 12. Dismounting closure cap 14 from container 12 allows liquid or solid product stored in an internal volume 16 of container 12 to be dispensed through an optional pour-spout insert 15 coupled to container 12 as suggested in FIG. 2. Closure cap 14 forms a cap seal with container 12 to block removal of the product when closure cap 14 is mounted on container 12 and to allow residual product captured in a residual-product catch basin 18 of closure cap 14 to flow back into container 12 through a drainback aperture 19 as suggested in FIG. 3.

Figure 2:
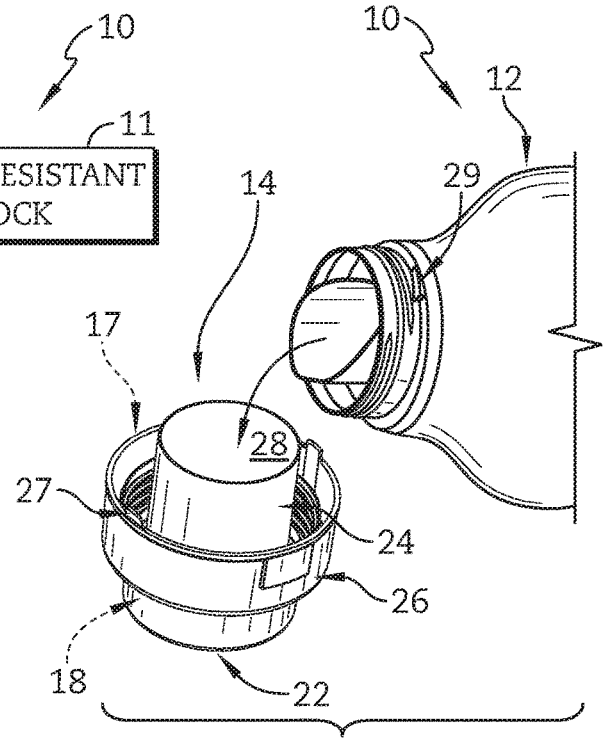
FIG. 2 is a partial perspective view of the package of FIG. 1 showing the closure cap removed from the container and suggesting that product stored within the container is poured through a discharge tube at the selection of a user into a product measuring cup of the closure cap to measure an amount of product discharged from the container.

Closure cap 14 includes a top wall 22, an annular inner sleeve 24 extending downwardly from top wall 22, and an outer shell 26 coupled to top wall 22 and arranged to extend around inner sleeve 24 as suggested in FIGS. 2 and 3. Inner sleeve 24 and top wall 22 cooperate to form a product measuring cup formed to include a product-receiving region 28 for receiving product to be measured by a consumer after removal of closure cap 14 from container 12 as suggested in FIG. 2. Residual product not dispensed from closure cap 14 flows along inner sleeve 24 toward top wall 22 while closure cap 14 is in a generally upright position, shown in FIG. 2, and is collected inside product-receiving region 28 and residual-product catch basin 18 along top wall 22.

Outer shell 26 includes a spout sealer 21, an annular inner sidewall 23, and an annular outer sidewall 25 as shown, for example, in FIG. 3. Spout sealer 21 is configured to engage with a neck 13 of container 12 to form the cap seal around pour-spout insert 15. Inner sidewall 23 of closure cap 14 is configured to engage with neck 13 of container 12 to hold closure cap 14 on container 12. Outer sidewall 25 is arranged to extend around inner sidewall 23. In the illustrative embodiment, outer sidewall 25 is formed to include pad 17.

Child-resistant lock 11 includes a lock tab 27 coupled to outer sidewall 25 of closure cap 14 and a companion stationary tab blocker 29 coupled to container 12 as suggested in FIGS. 1 and 2. Tab blocker 29 engages with lock tab 27 to block rotation of closure cap 14 relative to container 12 about axis A to block removal of closure cap 14. An adult user engages pad 17 of outer sidewall 25 to move lock tab 27 radially outward relative to tab blocker 29 to remove lock tab 27 from engagement with tab blocker 29 and allow removal of closure cap 14 from container 12 as suggested in FIG. 1. In some embodiments, a secondary lock tab and a secondary tab blocker are included as part of child-resistant lock 11. In some embodiments, outer sidewall 25 is formed to include a second pad opposite pad 17.

Pour-spout insert 15 is received in neck 13 of container 12 and closure cap 14 is arranged to cover pour-spout insert 15 when mounted on container 12 as suggested in FIGS. 4 and 5. Pour-spout insert 15 includes a product drainback cup 32 and a discharge tube 34 coupled to product drainback cup 32. Product drainback cup 32 includes an annular wall 36 and a bottom wall 38 coupled between annular wall 36 and discharge tube 34. In the illustrative embodiment, drainback aperture 19 is formed through a portion of annular wall 36 and a portion of bottom wall 38. In some embodiments, drainback aperture 19 is formed only through a portion of annular wall 36. In some embodiments, drainback aperture 19 is formed only through a portion of bottom wall 38.

Product drainback cup 32 of pour-spout insert 15 is configured to engage with neck 13 to hold pour-spout insert 15 on container 12 as suggested in FIGS. 3-5. Neck 13 includes an upper rim 31, an inner sealer wall 33, and a shoulder 35. A cup support 37 extends radially outward from an upper perimeter of product drainback cup 32 to engage with shoulder 35 of neck 13 to hold pour-spout insert 15 to container 12. In some embodiments, pour-spout insert 15 is press fit into neck 13. In some embodiments, pour-spout insert 15 is spun welded against neck 13. Discharge tube 34 of pour-spout insert 15 is configured to allow a user to pour product from container 12. Product drainback cup 32 of pour-spout insert 15 is configured to collect and direct residual product back into container 12 through drainback aperture 19. In the illustrative embodiment, bottom wall 38 is sloped toward drainback aperture 19 as suggested in FIG. 3.

Top wall 22 of closure cap 14 includes a spout cover 42 and a spacer wall 44 as shown in FIG. 3. Spout cover 42 and inner sleeve 24 define product-receiving region 28. An annular outer sleeve 46 extends downward from spacer wall 44 to couple outer shell 26 with top wall 22. Outer sleeve 46 is spaced apart radially from inner sleeve 24. Outer sleeve 46, inner sleeve 24, and spacer wall 44 together define residual-product catch basin 18.

Spout sealer 21, inner sidewall 23, and outer sidewall 25 of outer shell 26 are coupled to an annular top wall 48 extending radially outward from outer sleeve 46 as suggested in FIG. 7. Inner sidewall 23 is spaced radially outward from spout sealer 21, and outer sidewall 25 is spaced radially outward from inner sleeve 24. Spout sealer 21 includes an annular rim sealer 52 and an annular plug wall 54. Rim sealer 52 engages with rim 31 of neck 13 to form a contact seal with neck 13, as suggested in FIG. 7, when closure cap 14 is in a first angular position relative to container 12 as shown in FIG. 6. In the illustrative embodiment, lock tab 27 is spaced apart from tab blocker 29 when closure cap 14 is in the first angular position.

Plug wall 54 includes a flex section 51 and a plug mover 53 coupled to flex section 51 as suggested in FIG. 7. A sealer face 55 is defined along an outer perimeter of plug wall 54. Flex section 51 is coupled to annular top wall 48 and configured to allow plug wall 54 to flex relative to annular top wall 48. Plug mover 53 is configured to engage with neck 13 as closure cap 14 is being mounted on container 12 to flex plug wall 54 radially inward. Sealer face 55 of plug wall 54 engages with sealer wall 33 of neck 13 to form a plug seal. Rim sealer 52 becomes spaced apart from rim 31 and sealer face 55 remains engaged with sealer wall 33, as suggested in FIG. 9, as closure cap 14 rotates relative to container 12 from the first angular position to a second angular position as shown in FIG. 8. In the illustrative embodiment, lock tab 27 is engaged with tab blocker 29 when closure cap 14 is in the second angular position.

Another embodiment of a closure cap 214 in accordance with the present disclosure is shown in FIGS. 10 and 11. Closure cap 214 is configured to mount on container, such as container 12 of FIGS. 1-9, along an axis A. A tamper-evident band 200 is coupled to a lower perimeter edge of closure cap 214 by a frangible connection. A user removes tamper-evident band 200 along the frangible connection to allow closure cap 214 to dismount from the container.

Tamper-evident band 200 includes a strip 201 and a plurality of directionally molded retention tabs 202 spaced around an inner perimeter of strip 201 as shown in FIG. 11. Retention tabs 202 are configured to engage with the container when closure cap 214 is mounted thereon to block rotation and removal of closure cap 214 at the selection of a user. In the illustrative embodiment, retention tabs 202 are coupled along a lower perimeter edge of an annular sidewall 223 of closure cap 214 to form the frangible connection. A tear-away handle 203 is coupled to strip 201. A user engages tear-away handle 203 and pulls radially outward to remove strip 201 from closure cap 214 along the frangible connection. In some embodiments, tamper-evident band 200 is a break-torque band where rotation of closure cap 214 breaks the frangible connection with annular sidewall 223.

Closure cap 214 includes a top wall 222, an annular sleeve 224 extending downwardly from top wall 222, and an outer shell 226 arranged to extend around sleeve 224 as suggested in FIGS. 10 and 11. Sleeve 224 and top wall 222 cooperate to form a product measuring cup formed to include a product-receiving region 228 for receiving product to be measured by a consumer after removal of closure cap 214 from the container. Outer shell 226 includes a spout sealer 221 and the annular sidewall 223. An annular top wall 248 extends radially outward from sleeve 224 to couple outer shell 226 with sleeve 224 as suggested in FIG. 12. Spout sealer 221 is configured to engage with a neck of the container to form a cap seal to block removal of product within the container while closure cap 214 is mounted on the container. Annular sidewall 223 of closure cap 214 is configured to engage with the neck of the container to hold closure cap 214 on the container. An upper portion 246 of sleeve 224 forms a grip for handling closure cap 214.

A lock tab 227 is coupled to a lower perimeter edge of annular sidewall 223 and is configured to engage with a companion stationary tab blocker coupled to the container as part of a child-resistant lock as suggested in FIG. 11. A gap 204 is formed between at least some of retention tabs 202 on strip 201 so that tamper-evident band 200 does not engage lock tab 227. Lock tab 227 engages with the tab blocker to block rotation of closure cap 214 relative to the container about axis A to block removal of closure cap 214. An adult user engages a pad 217 of annular sidewall 223 to move lock tab 227 radially outward relative to the tab blocker to remove lock tab 227 from engagement with the tab blocker and allow removal of closure cap 214 from the container. In some embodiments, a secondary lock tab 227 and a secondary tab blocker are included as part of the child-resistant lock. In the illustrative embodiment, pad 217 is angularly spaced from one of the lock tabs 227 by an angle Y and from the other of the lock tabs 227 by an angle X. In some embodiments, angle Y and angle X are equal. In some embodiments, angle Y is larger than angle X. In some embodiments, angle X is larger than angle Y. In some embodiments, angle Y is about 90 degrees. In some embodiments, angle Y is less than about 90 degrees. In some embodiments, angle Y is about 45 degrees. In some embodiments, angle X is about 90 degrees. In some embodiments, angle X is less than about 90 degrees. In some embodiments, angle X is about 45 degrees.

Spout sealer 221 includes an annular rim sealer 252 and an annular plug wall 255 as shown in FIG. 13. Rim sealer 252 engages with a rim of the neck of the container to form a contact seal with the neck. Plug wall 254 includes a flex section 251 and a plug mover 253 coupled to flex section 251. A sealer face 255 is defined along an outer perimeter of plug wall 254. Flex section 251 is coupled to annular top wall 248 and configured to allow plug wall 254 to flex relative to annular top wall 248. Plug mover 253 is configured to engage with the neck as closure cap 214 is being mounted on the container to flex plug wall 254 radially inward. Sealer face 255 of plug wall 254 engages with the neck to form a plug seal. In some embodiments, sealer face 255 remains engaged with the neck as rim sealer 252 becomes spaced apart from the rim of the neck as closure cap 214 is rotated relative to the container.

In some embodiments, tamper-evident band 200 is included in closure cap 14 and coupled to a lower perimeter edge of annular outer sidewall 25. In some embodiments, closure cap 214 includes a residual-product catch basin similar to residual-product catch basin 18 shown in FIG. 3. In some embodiments, closure caps 14, 214 are formed from substantially rigid and resilient materials, such as plastic for example. In some embodiments, other types of connections are used in place of threaded connections, such as lock and key or groove and tab arrangements for example.

In one example, a tamper-evident band is a tear-away tamper-evident band as shown in FIG. 10. In another example, the tamper evident band is a snap-away tamper-evident band. Any suitable tamper-evident band may be used with the present disclosure.

The invention claimed is:

1. A closure cap for a container comprising a top wall, an inner sleeve arranged to extend downwardly away from the top wall and around an axis of the closure cap, a portion of the top wall and the inner sleeve cooperating to define a region therein, an outer sleeve coupled to the top wall and arranged to extend around the inner sleeve, and an outer shell arranged to extend around the inner sleeve and coupled to the top wall in a fixed position relative to the top wall, wherein the outer shell includes an inner sidewall and an outer sidewall, the inner sidewall is configured to engaged with a neck of a container, and the outer sidewall is arranged to extend around the inner sidewall.

2. The closure cap of claim 1, wherein the outer sleeve is coupled to the top wall and spaced radially outward relative to the axis from the inner sleeve and the inner sleeve and outer sleeve cooperate to define, at least in part, a basin, and wherein the inner sleeve is spaced radially from the axis a first distance, spaced radially from the outer sleeve a second distance, and the first distance is less than the second distance.

3. The closure cap of claim 1, wherein the outer shell is arranged to extend away from the top wall, and wherein the closure cap further comprises a lock tab coupled to the outer shell.

4. The closure cap of claim 3, further comprising a plug wall coupled to the outer shell and a rim sealer coupled to the outer shell to locate the plug wall between the axis and the rim sealer, and wherein the lock tab is spaced apart from the plug wall and a tab blocker coupled to the container.

5. The closure cap of claim 4, wherein the inner sidewall is located radially outward of the outer sleeve to locate the rim sealer between the inner sidewall and the outer sleeve relative to the axis.

6. The closure cap of claim 3, further comprising a tamper-evident band coupled to the outer shell, wherein the tamper evident band includes a frangible strip connected to the outer shell and retention tabs configured to engage with a retainer, and wherein the lock tab is positioned between adjacent retention tabs when the tamper-evident band is coupled to the outer shell.

7. The closure cap of claim 3, wherein the outer shell is formed to include a pad on the outer shell configured to cause the lock tab to move outward of a tab blocker coupled to the container to disengage the lock tab from the tab blocker and allow removal of the closure cap from the container.

8. The closure cap of claim 7, wherein the pad is angularly spaced apart from the lock tab by about 90 degrees around the axis.

9. The closure cap of claim 7, wherein the pad is angularly spaced apart from the lock tab by less than about 90 degrees around the axis.

10. A closure cap for a container comprising a top wall, an inner sleeve arranged to extend downwardly away from the top wall and around an axis of the closure cap, the inner sleeve cooperating with a portion of the top wall to define a region therein, an outer sleeve coupled to the top wall and arranged to extend around the inner sleeve, and an outer shell arranged to extend around the inner sleeve and coupled to the top wall in a fixed position relative to the top wall, wherein the outer sleeve is spaced radially outward from the inner sleeve and the inner sleeve and outer sleeve cooperate to define, at least in part, a basin, and wherein the outer shell includes an inner sidewall and an outer sidewall, the inner sidewall is configured to engage with a neck of a container, and the outer sidewall is arranged to extend around the inner sidewall.

11. The closure cap of claim 10, further comprising a lock tab coupled to the outer shell.

12. The closure cap of claim 11, further comprising a plug wall coupled to the outer shell and a rim sealer coupled to the outer shell to locate the plug wall between the axis and the rim sealer, wherein the lock tab is spaced apart from the plug wall and a tab blocker coupled to the container.

13. The closure cap of claim 12, wherein the outer shell is formed to include a pad on the outer shell configured to cause the lock tab to move outward of the tab blocker to disengage the lock tab from the tab blocker and allow removal of the closure cap from the container and the pad is angularly spaced apart from the lock tab by about 90 degrees around the axis.

14. The closure cap of claim 12, wherein the inner sidewall is located radially outward of the outer sleeve to locate the rim sealer between the inner sidewall and the outer sleeve relative to the axis.

15. The closure cap of claim 10, further comprising a tamper-evident band coupled to the outer shell.

16. The closure cap of claim 15, wherein the tamper evident band includes a frangible strip connected to the outer shell and retention tabs configured to engage with a retainer.

17. The closure cap of claim 10, wherein the inner sleeve is spaced radially from the axis a first distance, the inner sleeve is spaced radially from the outer sleeve a second distance, and the first distance is less than the second distance.

18. A package comprising a container formed to include an opening arranged to open into an internal volume formed in the container and adapted to store a product therein, and a closure cap arranged to mount on the container along an axis, the closure cap including a top wall having a spout cover and a spacer wall, an inner sleeve extending downwardly from the top wall, an outer sleeve extending downwardly from the top wall and located radially outward of the inner sleeve relative to the axis, and an outer shell having an inner sidewall located radially outward of the outer sleeve relative to the axis and having an internal thread configured to mount the closure cap on a neck of the container, wherein the spout cover and the inner sleeve cooperate to define a product-receiving region, and wherein the spacer wall, the inner sleeve, and the outer sleeve cooperate to define a basin located radially outward of the product-receiving region.

19. The package of claim 18, wherein the outer shell further includes a plug wall and a rim sealer configured to engage with at least a portion of the neck of the container to form a contact seal with the neck, wherein the plug wall is located between the axis and the rim sealer, and the rim sealer is located between the plug wall and the inner sidewall.

20. The package of claim 19, further comprising a second top wall extending radially outward from a lower end of the outer sleeve, and wherein the spout sealer and the inner sidewall are coupled to the second top wall.

* * * * *